US009158287B2

(12) United States Patent
Ono

(10) Patent No.: US 9,158,287 B2
(45) Date of Patent: Oct. 13, 2015

(54) INFORMATION PROCESSING APPARATUS FOR UPDATING LOCAL TIME

(71) Applicant: Takatoshi Ono, Nagoya (JP)

(72) Inventor: Takatoshi Ono, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/148,902

(22) Filed: Jan. 7, 2014

(65) Prior Publication Data

US 2014/0192624 A1 Jul. 10, 2014

(30) Foreign Application Priority Data

Jan. 10, 2013 (JP) ..... 2013-002784

(51) Int. Cl.

| | |
|---|---|
| ***G04G 7/00*** | (2006.01) |
| ***G04R 20/18*** | (2013.01) |
| ***G04R 20/14*** | (2013.01) |
| ***G04R 20/00*** | (2013.01) |
| ***G04R 20/30*** | (2013.01) |

(52) U.S. Cl.

CPC *G04R 20/18* (2013.01); *G04G 7/00* (2013.01); *G04R 20/00* (2013.01); *G04R 20/14* (2013.01); *G04R 20/30* (2013.01)

(58) Field of Classification Search

CPC ..... G04G 7/00; G04G 7/023; G04G 7/026; G04R 20/14; G04R 20/00; G04R 20/18; G04R 20/30

USPC ..... 368/46, 47, 21, 59

See application file for complete search history.

(56) References Cited

U.S. PATENT DOCUMENTS

| | | | | |
|---|---|---|---|---|
| 5,918,040 | A * | 6/1999 | Jarvis | 713/375 |
| 6,496,198 | B1 | 12/2002 | Wang | |
| 7,617,410 | B2 * | 11/2009 | Check et al. | 713/503 |
| 2003/0067844 | A1 * | 4/2003 | Liaw | 368/47 |
| 2003/0185104 | A1 * | 10/2003 | Goergen | 368/47 |
| 2004/0179432 | A1 * | 9/2004 | Burke | 368/46 |
| 2005/0232086 | A1 * | 10/2005 | Jiddou et al. | 368/47 |
| 2006/0002236 | A1 * | 1/2006 | Punkka | 368/21 |
| 2006/0155495 | A1 * | 7/2006 | Osorio et al. | 702/89 |

(Continued)

FOREIGN PATENT DOCUMENTS

| | | |
|---|---|---|
| JP | H06-109877 A | 4/1994 |
| JP | H11-129487 A | 5/1999 |

(Continued)

*Primary Examiner* — Amy Cohen Johnson
*Assistant Examiner* — Matthew Powell
(74) *Attorney, Agent, or Firm* — Scully, Scott, Murphy & Presser, P.C.

(57) ABSTRACT

An information processing apparatus includes: a communication device communicating with an external device and a clock server; a first clock measuring a local time; a second clock measuring a time based on time information from the clock server; a storage device storing setting information; and a controller performing: when receiving the time information from the external device, judging whether a specified condition is met; when the specified condition is met, setting a time indicated by the time information to the first clock as the local time; when the specified condition is met, controlling the first clock to measure the local time, without the controller setting the time to the first clock as the local time; setting the time indicated by the time information to the second clock and setting a time determined based on the time of the second clock and the setting information to the first clock.

8 Claims, 5 Drawing Sheets

(56) References Cited

U.S. PATENT DOCUMENTS

| | | | | |
|---|---|---|---|---|
| 2007/0206442 | A1* | 9/2007 | Kim | 368/21 |
| 2009/0168609 | A1* | 7/2009 | Weir et al. | 368/21 |
| 2011/0051559 | A1* | 3/2011 | Oh | 368/10 |

FOREIGN PATENT DOCUMENTS

| | | | |
|---|---|---|---|
| JP | 2001-028684 | A | 1/2001 |
| JP | 2002-094492 | A | 3/2002 |
| JP | 2006-058040 | A | 3/2006 |

* cited by examiner

INFORMATION PROCESSING APPARATUS FOR UPDATING LOCAL TIME

CROSS REFERENCE TO RELATED APPLICATION

The present application claims priority from Japanese Patent Application No. 2013-002784, which was filed on Jan. 10, 2013, the disclosure of which is herein incorporated by reference to its entirety.

BACKGROUND OF THE INVENTION

1. Field of the Invention

The present invention relates to an information processing apparatus.

2. Description of Related Art

There has been known a printer which, when the printer is connected to a host computer and a power thereof is first on, receives time information from the host computer and updates a time based on the time information as a local time. For example, the conventional printer, after the printer first updated the time based on the time information received from the host computer as described above, at predetermined time intervals, receives the time information from the host computer and updates the time based on the time information received from the host computer as the local time, in a case where there is a time difference between the time based on the time information received from the host computer and the local time of the printer.

Further, there has been known an information processing apparatus which receives the time information at the predetermined time intervals from a clock server which provides the time information. For example, the clock server provides the time information with reference to the Universal Time Coordinated (UTC). The information processing apparatus sets a time based on the time information received from the clock server as the local time of the information processing apparatus.

SUMMARY OF THE INVENTION

In the information processing apparatus capable of receiving the time information from each of the host computer (an external device) and the clock server, each of which is connected to the information processing apparatus, it is desired to improve convenience regarding setting of the local time.

It is therefore an object of the present invention to provide an information processing apparatus capable of receiving time information from each of an external device and a clock server so as to improve convenience regarding setting of a local time.

In order to achieve the above-mentioned object, according to the present invention, there is provided an information processing apparatus comprising: a communication device capable of communicating with an external device and a clock server configured to provide time information; a first clock configured to measure a local time; a second clock configured to measure a time based on the time information provided from the clock server; a storage device configured to store setting information for determining a local time based on the time measured by the second clock; and a controller configured to perform: judging whether a specified conditions is met, when the time information from the external device is received, setting a time indicated by the time information received from the external device to the first clock as the local time, when it is judged that the specified conditions is met, controlling the first clock to measure the local time, without the controller setting the time indicated by the time information received from the external device to the first clock as the local time, when it is judged that the specified conditions is not met, when the time information from the clock server is received, setting the time indicated by the time information received from the clock server to the second clock, and setting a time determined based on the time measured by the second clock and the setting information stored in the storage device to the first clock as the local time.

BRIEF DESCRIPTION OF THE DRAWINGS

The above and other objects, features, advantages and technical and industrial significance of the present invention will be better understood by reading the following detailed description of preferred embodiments of the invention, when considered in connection with the accompanying drawings, in which.

DETAILED DESCRIPTION OF THE PREFERRED EMBODIMENTS

Figure 1:
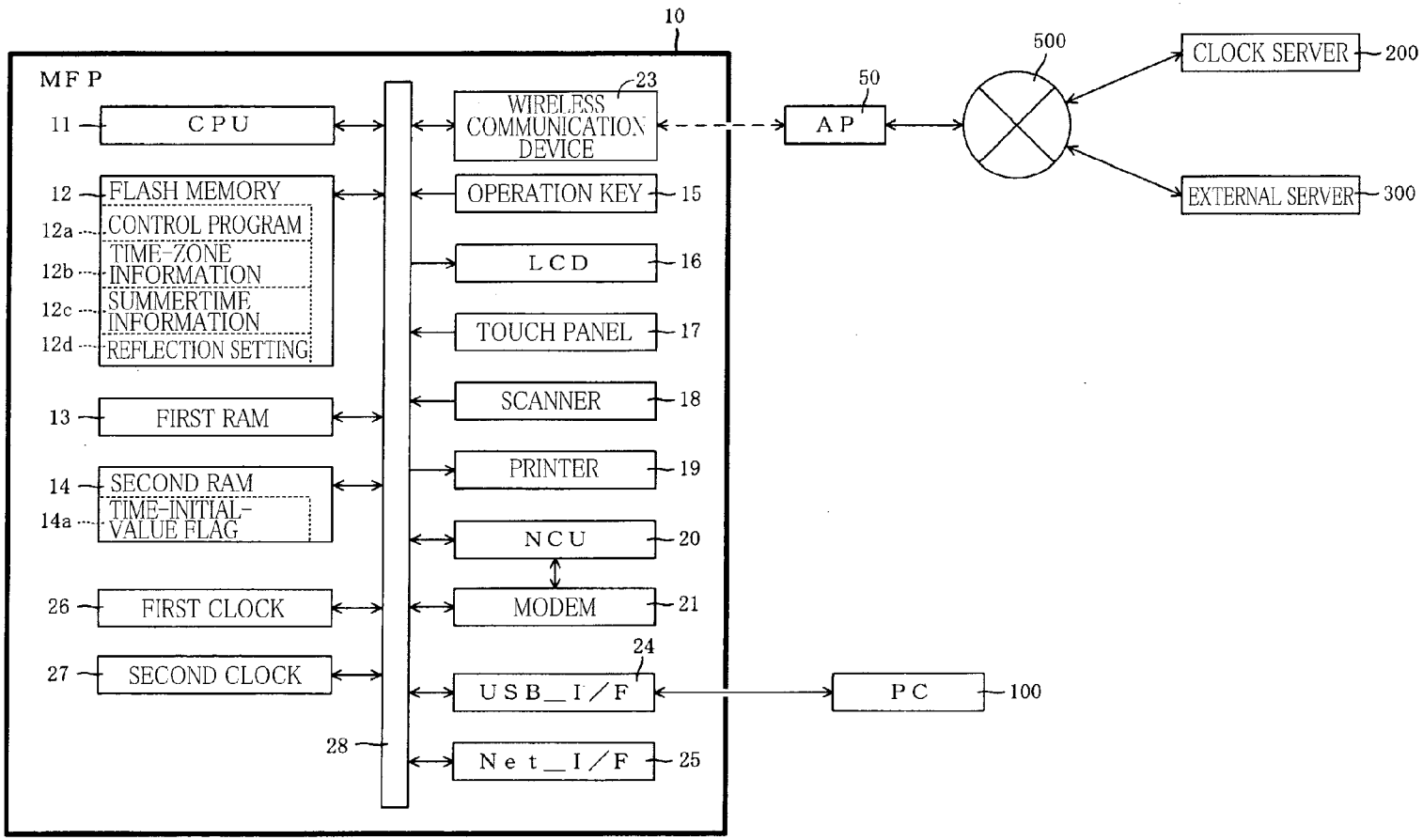
FIG. 1 is a block diagram showing an electrical structure of a Multi Function Peripheral (MFP) as a first embodiment to which the present invention is applied.

Hereinafter, there will be described preferred embodiments of the invention with reference to the drawings. First, there will be described a first embodiment of the present invention with reference to FIGS. 1 and 2. FIG. 1 shows a Multi Function Peripheral (hereinafter, referred to as "MFP") 10 as one embodiment of an image forming apparatus. The MFP 10 has various functions such as a printer function, a facsimile function, a scanner function, a copier function and so on. The MFP 10 is capable of receiving time information from each of a personal computer (hereinafter, referred to as "PC") 100 and a clock server 200 and being synchronized with a local time of the MFP 10 based on the time information from each of the PC 100 and the clock server 200.

In the MFP 10, there are mainly disposed a CPU (Central Processing Unit) 11, a flash memory 12, a first RAM (Random Access Memory) 13, a second RAM 14, operation keys 15, an LCD (Liquid Crystal Display) 16, a touch panel 17, a scanner 18, a printer 19, an NCU (Network Control Unit) 20, a modem 21, a wireless communication device 23, a USB (Universal Serial Bus) interface (USB I/F) 24, a network interface (Net I/F) 25, a first clock 26, and a second clock 27, which are connected to each other through an Input/Output port (I/O port) 28.

The CPU 11 controls various functions that the MFP 10 has and various elements of the MFP 10 connected to the I/O port 28, according to fixed values and programs that are stored in the flash memory 12, data that are stored in the first RAM 13, or various signals transmitted or received through the NCU 20. The flash memory 12 is a nontransitory memory and stores a control program 12*a* for controlling operations of the MFP 10 and so forth. The CPU 11 executes each processing shown in each of flow charts of FIGS. 2A through 2C according to the control program 12*a*. The flash memory 12 also stores time-zone information 12*b*, summertime information 12*c* and a reflection setting 12*d*. The time-zone information 12*b* is information indicating a time difference relative to a certain time based on time information with reference to the Universal Time Coordinated (UTC). The summertime information 12*c* is information indicating whether summertime (daylight saving time) is set. The reflection setting 12*d* is information that, when the time information with reference to the UTC is received from the clock server 200, indicates whether synchronizing of the first clock 26 should be performed based on the received time information. Before shipment of the MFP 10, predetermined initial values are stored as the time-zone information 12*b*, the summertime information 12*c* and the reflection setting 12*d*, respectively. Each of the initial values of the time-zone information 12*b*, the summertime information 12*c* and the reflection setting 12*d* can be changed on a certain screen displayed on the LCD 16 by input of a user as necessary.

The first RAM 13 is a rewritable and transitory memory having a temporary area for temporarily storing various data when the CPU 11 executes the control program 12*a*. The second RAM 14 is also a rewritable and transitory memory similar to the first RAM 13, excepting that the second RAM 14 is capable of keeping the stored contents by a power supplied from a battery (not shown), even in a state in which a main power source of the MFP 10 is off. The second RAM 14 stores a time-initial-value flag 14*a*. The time-initial-value flag 14*a* is a flag indicating whether a time set to the first clock 26 is a time set at the shipment. In a case where the time-initial-value flag 14*a* is OFF, it indicates that the time set to the first clock 26 is not changed from the time set at the shipment, and in a case where the flag 14*a* is ON, it indicates the time set to the first clock 26 is changed from the time set at the shipment. The time-initial value flag 14*a* is set OFF at the shipment, and is set ON when the time set to the first clock 26 is changed from the time set at the shipment. As mentioned above, the stored contents in the second RAM 14 are kept by the power supplied from the battery, so that, when the battery runs down in a state in which the main power source of the MFP 10 is off, the contents stored in the second RAM 14 are lost. In this case, the time-initial-value flag 14*a* is initialized to be OFF.

The operation keys 15 are mechanical keys for receiving various setting values and instructions from the user. The LCD 16 is a liquid crystal display device for displaying various screens. The touch panel 17 is disposed in layers on the LCD 16, and, for example, when an indicating tool such as a finger, a stick or the like contacts or comes close to a screen displayed on the LCD 16, the touch panel 17 detects a position on the LCD 16 where the indicating tool contacts or comes close to and inputs the position on the LCD 16 to the CPU 11. The scanner 18 reads an original document and converts it into image data. The printer 19 prints an image based on the image data on a recording sheet. The modem 21 modulates image data that should be transmitted during facsimile transmission into signals available for transmission to telephone line network, and transmits the signals through the NCU 20. The modem 21 demodulates signals inputted from the telephone line network through the NCU 20 into image data. The NCU 20 connects the telephone line network (not shown) and the MFP 10 to each other, and controls connection between the telephone line network and the MFP 10 by closing or cutting off the telephone line according to instructions from the modem 21.

The wireless communication device 23 is an interface for wireless communication. The wireless communication device 23 connects the MFP 10 to an access point (AP) 50 by wireless LAN (Local Area Network) in accordance with the standard IEEE 802.11b/g. The MFP 10 is communicable with the clock server 200 or an external server 300 on the Internet 500 through the AP 50. The USB I/F 24 is a device to communicably connect the MFP 10 to an external device such as the PC 100, a storage medium including a USB memory and so on, and is constituted by a well-known device. The Net I/F 25 is an interface for connecting the MFP 10 to network such as the Internet (not shown), LAN, and so forth.

The first clock 26 is a clock for timing (measuring) a local time of the MFP 10. The second clock 27 is a clock for timing a time based on the time information with reference to the UTC (hereinafter, referred to as a "UTC time"). The local time measured by the first clock 26 is, for example, used as a time displayed on the LCD 16. Further, as one scanner function, in a case where image data formed by reading with the scanner 18 are saved as an image file in portable media such as a USB memory, the local time is used as a part of a file name in order to distinguish one of file names of various image files from the others. On the other hand, the time measured by the second clock 27, i.e., the UTC time is used in a case where the authentication is performed in the external sever 300 such as a cloud server on the Internet 500. Thus, the MFP 10 in the present embodiment is configured to be capable of timing (measuring) each of the local time and the UTC time, and each of the (local) time measured by the first clock 26 and the (UTC) time measured by the second clock 27 is used depending on situations suitable for each of the times.

A predetermined value as an initial value (an initial time) is set to each of the first clock 26 and the second clock 27 of the MFP 10 at shipment of the MFP 10. The first clock 26 is capable of being synchronized with a local time calculated based on the time information received from the clock server 200 and also capable of being synchronized with a local time of the PC 100 received from the PC 100 that is connected to the MFP 10. Therefore, even in a case where the MFP 10 is installed at a place where the MFP 10 is unable to be connected to the Internet 500, i.e., a place where the MFP 10 is unable to be connected to the clock server 200, the MFP 10 is connected to the PC 100 such that the local time can be set to the first clock 26. On the other hand, the second clock 27 is capable of being synchronized with a time based on the time information received from the clock server 200. Therefore, the MFP 10 enables the second clock 27 to time (measure) the UTC time that is a highly accurate time with reference to the UTC, so that the authentication can be certainly performed in the external server 300 such as a cloud server on the Internet 500.

The clock server 200 is a SNTP (Simple Network Time Protocol) server or a NTP (Network Time Protocol) server which provides time information on the Internet 500 with reference to the UTC. The external server 300 is a server other than the clock server 200, for example, a DNS (Domain Name System) server or a cloud server. The MFP 10 performs the name resolution by referring to the DNS server as one example of the external server 300 and is connected to the clock server 200 to which the name resolution has been performed so as to receive the time information from the connected clock server 200. The MFP 10 may be connected to the clock server 200 that is specified (designated) by the DHCP (Dynamic Host Configuration Protocol) and receive the time information from the specified clock server 200.

Figure 2A:
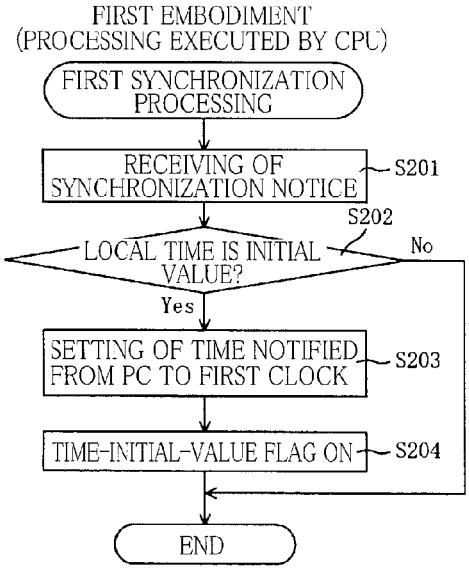
FIGS. 2A through 2C are flow charts showing a first synchronization processing, a second synchronization processing, and a reflection setting processing, respectively.

FIG. 2A is a flow chart showing a first synchronization processing. The first synchronization processing is a processing executed by the CPU 11 according to the control program 12*a* and is a processing in which a time is set to the first clock 26 based on the time information received from the PC 100. The processing starts when a synchronization notice is received from the PC 100 in USB connection with the MFP 10 through the USB I/F 24. In more detail, when the USB connection between the MFP 10 and the PC 100 is established, and then a connection between the MFP 10 and a resident application installed in the PC 100 for monitoring a status of the MFP 10 is established, the PC 100 transmits the synchronization notice including a local time timed (measured) by the PC 100 to the MFP 10 according to the resident application. When the MFP 10 receives the synchronization notice, the first synchronization processing is started.

The CPU 11, in step S201 (hereinafter, "step" is omitted), receives the synchronization notice transmitted from the PC 100 through the USB I/F 24. Next, the CPU 11 judges whether a local time set in the first clock 26 is an initial value (an initial time) (S202). This judgment is performed based on a value of the time-initial-value flag 14*a*. More precisely, in a case where the time-initial-value flag 14*a* is OFF, the CPU 11 judges that the local time set in the first clock 26 is the initial value. On the other hand, in a case where the time-initial-value flag 14*a* is ON, the CPU 11 judges that the local time set in the first clock 26 is not the initial value.

In S202, when the CPU 11 judges that the local time set in the first clock 26 is the initial value (S202: YES), the CPU 11 sets a time indicated in the time information included in the synchronization notice as a local time of the MFP 10 to the first clock 26 (S203), and sets the time-initial-value flag 14*a* ON (S204), and ends executing of the processing. On the other hand, when the CPU 11 judges that the local time set in the first clock 26 is not the initial value (S202: NO), the CPU 11 ends executing of the processing.

Figure 2B:
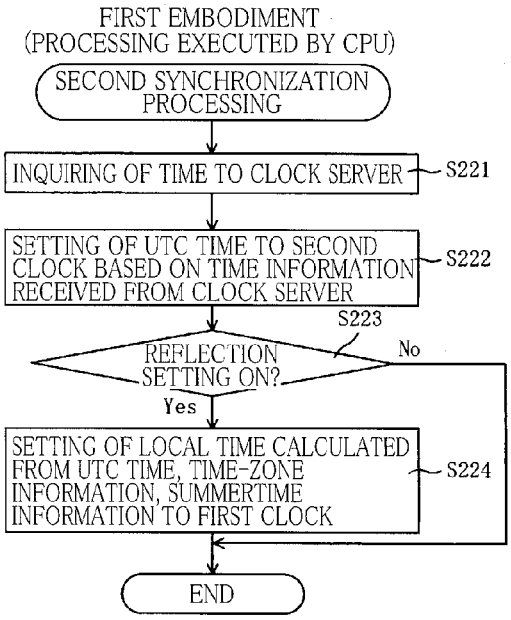

FIG. 2B is a flow chart showing a second synchronization processing. The second synchronization processing is a processing executed by the CPU 11 according to the control program 12*a* and is a processing in which a time based on the time information received from the clock server 200 is set to the second clock 27 and the local time calculated based on the time timed by the second clock 27 is set to the first clock 26. The second synchronization processing starts at predetermined time intervals, for example, every 24 hours, in a state in which the MFP 10 and the clock server 200 are connected to each other so as to be communicable with each other.

The CPU 11 inquires a time of the clock server 200 through the wireless communication device 23 (S221). The clock server 200, corresponding to the inquiry, transmits the time information with reference to the UTC to the MFP 10. The CPU 11 sets the UTC time to the second clock 27, based on the time information received from the clock server 200 through the wireless communication device 23 (S222).

Next, the CPU 11 judges whether the reflection setting 12*d* is ON (S223). That the reflection setting 12*d* is ON means that the reflection setting 12*d* is a value indicating that the synchronization of the first clock 26 should be performed based on the time information received from the clock server 200. On the other hand, that the reflection setting 12*d* is OFF means that the reflection setting 12*d* is a value indicating that the synchronization of the first clock 26 is not performed based on the time information received from the clock server 200. An initial value of the reflection setting 12*d* stored in the MFP 10 at the shipment of the MFP 10 is OFF. When the CPU 11 judges that the reflection setting 12*d* is ON (S223: YES), the CPU 11 sets the local time calculated from the UTC time timed by the second clock 27, the time-zone information 12*b* and the summertime information 12*c* to the first clock 26 (S224), and ends the processing. On the other hand, when the CPU 11 judges that the reflection setting 12*d* is OFF (S223: NO), the CPU 11 ends the processing.

Figure 2C:
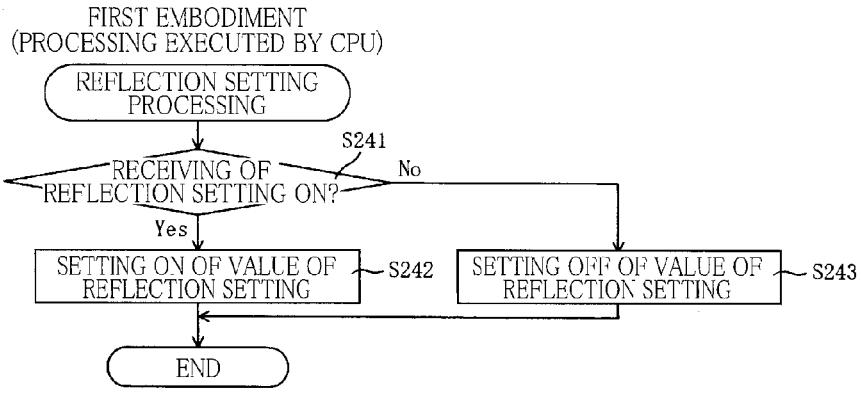

FIG. 2C is a flow chart showing a reflection setting processing. The reflection setting processing is a processing in which a value of the reflection setting 12*d* is set based on input of the user. The reflection setting processing starts when the CPU 11 receives an ON input or an OFF input of the reflection setting 12*d* based on the user's input. When the CPU 11 judges that the ON input of the reflection setting 12*d* is received (S241: YES), the CPU 11 sets the value of the reflection setting 12*d* at ON (S242), and ends the processing. On the other hand, in S241, when the CPU 11 judges that the ON input of the reflection setting 12*d* is not received (S241: NO), the CPU 11 sets the value of the reflection setting 12*d* at OFF (S243), and ends the processing.

In general, time information received from a host computer such as the PC 100 is less accurate than the time information received from the clock server 200. Therefore, it is possible that, even if the accurate local time had been set based on the time information received from the clock server 200, every time the time information is received from the host computer, the local time is updated to the local time based on the time information received from the host computer, i.e., the local time with relatively low accuracy.

On the other hand, in a case where the time information is received only from the clock server 200, the accurate local time can be always set. However, for example, in a situation in which the MFP 10 is unable to be connected to the clock server 200, it is possible to cause a time difference between the local time of the MFP 10 and the accurate time. Since the longer a state in which the MFP 10 cannot be connected to the clock server 200 becomes, the longer a period in which the MFP 10 cannot receive the time information becomes. In particular, in a case where the MFP 10 is unable to be connected to the clock server 200 when the power is switched on, the local time of the MFP 10 cannot be set without the user's operation, causing to inconvenience.

Therefore, in an information processing apparatus capable of receiving the time information from each of the host computer (the PC 100) connected thereto and the clock server 200, it is desired to increase the convenience regarding setting of the local time.

In consideration of the above-mentioned circumstances, in the MFP 10 of the present embodiment, even if the synchronization notice is received from the PC 100, the synchronization of the first clock 26 based on the time information included in the synchronization notice is performed only in a case where the local time set in the first clock 26 is the initial value. On the other hand, in a case where the time information is received from the clock server 200, the synchronization of the first clock 26 is performed, whether the local time set in the first clock 26 is the initial value or not. Accordingly, the first clock 26, which is synchronized with the local time with high accuracy and calculated based on the time information provided from the clock server 200, i.e., the time information with reference to the UTC, is restrained from being corrected to the local time based on the time information from the PC 100, when the local time of the PC 100 as the time information is received from the PC 100. Therefore, the MFP 10 in the present embodiment enables a state in which measurement of the local time by the first clock 26 can be performed with high accuracy to be kept long, and enjoys the convenience.

Further, in a case where the local time set in the first clock 26 is the initial value, the local time can be set to the first clock 26 based on the time information received from any one of the clock server 200 and the PC 100. Therefore, even if the MFP 10 is installed at a place where the MFP 10 cannot be connected to the Internet 500, i.e., a place where the MFP 10 cannot be connected to the clock server 200, the MFP 10 is connected to the PC 100, so that the local time can be set to the first clock 26.

Furthermore, the synchronization of the first clock 26 based on the time information provided from the clock server 200 is performed on condition that the reflection setting 12*d* is ON. Since the reflection setting 12*d* is set ON or OFF by the user's input, the synchronization of the first clock 26 based on the time information provided from the clock server 200 can be performed corresponding to the user's intention. In particular, since the initial value of the reflection setting 12*d* is OFF, in a case where the reflection setting 12*d* is ON, the reflection setting 12*d* has been changed from OFF to ON at least once based on the user's input. In other words, in a case where the reflection setting 12*d* is ON, the user desires the synchronization of the first clock 26 based on the time information provided from the clock server 200. Accordingly, the synchronization of the first clock 26 can be restrained when the user does not intend the synchronization.

Hereinafter, a second embodiment will be described with reference to FIG. 3A. In the illustrated first embodiment, the time-zone information 12*b* and the summertime information 12*c* are set by the user's input. In the second embodiment, the time-zone information 12*b* and the summertime information 12*c* are automatically set based on a global IP address of the MFP 10. In the second embodiment, the identical elements will be denoted by the reference numerals used in the first embodiment, and description thereof is omitted.

Figure 3A:
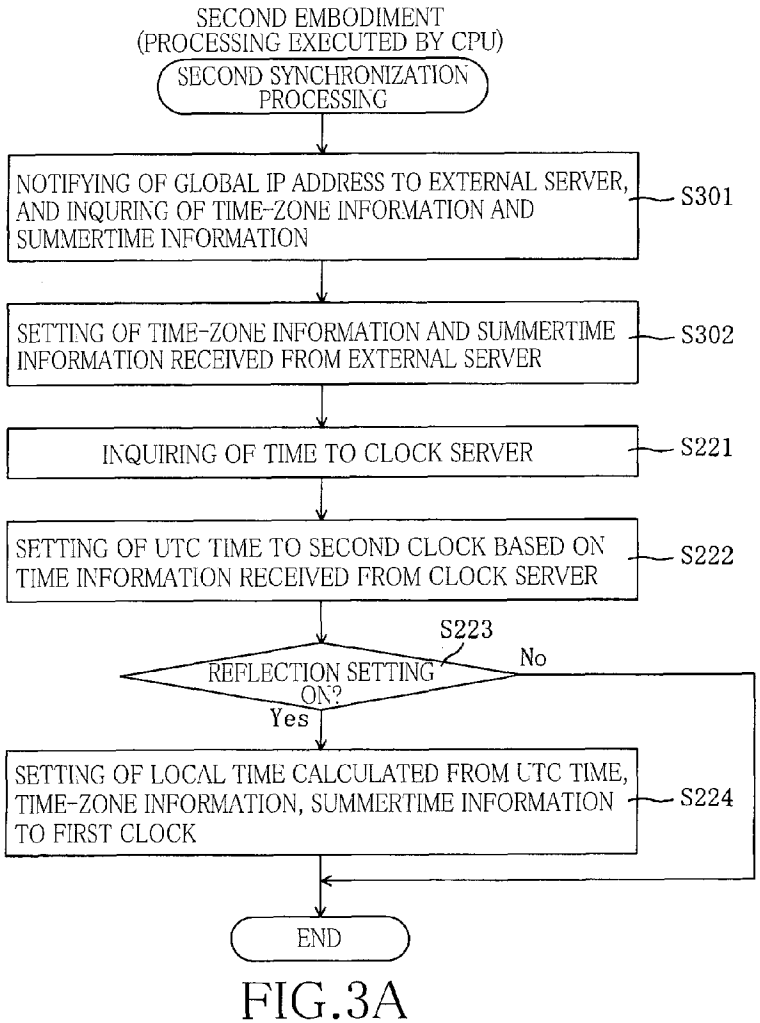
FIG. 3A is a flow chart showing a second synchronization processing in a second embodiment of the present invention.

FIG. 3A is a flow chart illustrating a second synchronization processing in the second embodiment. The second synchronization processing is a processing executed by the CPU 11 according to the control program 12*a* that the MFP 10 in the second embodiment carries. The second synchronization processing starts at predetermined time intervals (for example, every 24 hours), in a state in which the MFP 10 and the clock server 200 are connected to each other so as to be communicable with each other.

The CPU 11 notifies the global IP address of the MFP 10 to the external server 300 through the wireless communication device 23 and inquires time-zone information and summertime information (S301). In S301, the external sever 300 to which the MFP 10 inquires the time-zone information and the summertime information stores an information table in which an area specified by the global IP address is associated with the time-zone information and the summertime information. The external server 300 inquired by the MFP 10 refers to the information table, acquires the time-zone information and the summertime information associated with the area specified by the notified global IP address, and transmits the time-zone information and the summertime information acquired by the external server 300 to the MFP 10.

The CPU 11 sets and stores the time-zone information and the summertime information received from the external server 300 through the wireless communication device 23 as the time-zone information 12*b* and the summertime information 12*c*, respectively (S302). After S302, the CPU 11 executes S221 through S224 and ends the processing, similarly in the first embodiment.

Since the MFP 10 in the second embodiment acquires the time-zone information and the summertime information associated with the area specified by the global IP address of the MFP 10 from the external server 300 and set them as the time-zone information 12*b* and the summertime information 12*c*, respectively. Therefore, even in a case where the MFP 10 is installed at a place where different time-zone information and different summertime information are applied, the local time is calculated based on the UTC time measured by the second clock 27 with high accuracy, and the local time can be automatically set to the first clock 26 in accordance with installation places of the MFP 10.

Hereinafter, a third embodiment will be described with reference to FIG. 3B. In the second embodiment, by the notice of the global IP address of the MFP 10 and the inquiry of the external server 300, the MFP 10 acquires the time-zone information and the summertime information corresponding to the installation places of the MFP 10. In the third embodiment, the time-zone information and the summertime information are set based on the global IP address of the MFP 10 received from the external server 300. In the third embodiment, the identical elements will be denoted by the reference numerals used in the first embodiment, and description thereof is omitted.

Figure 3B:
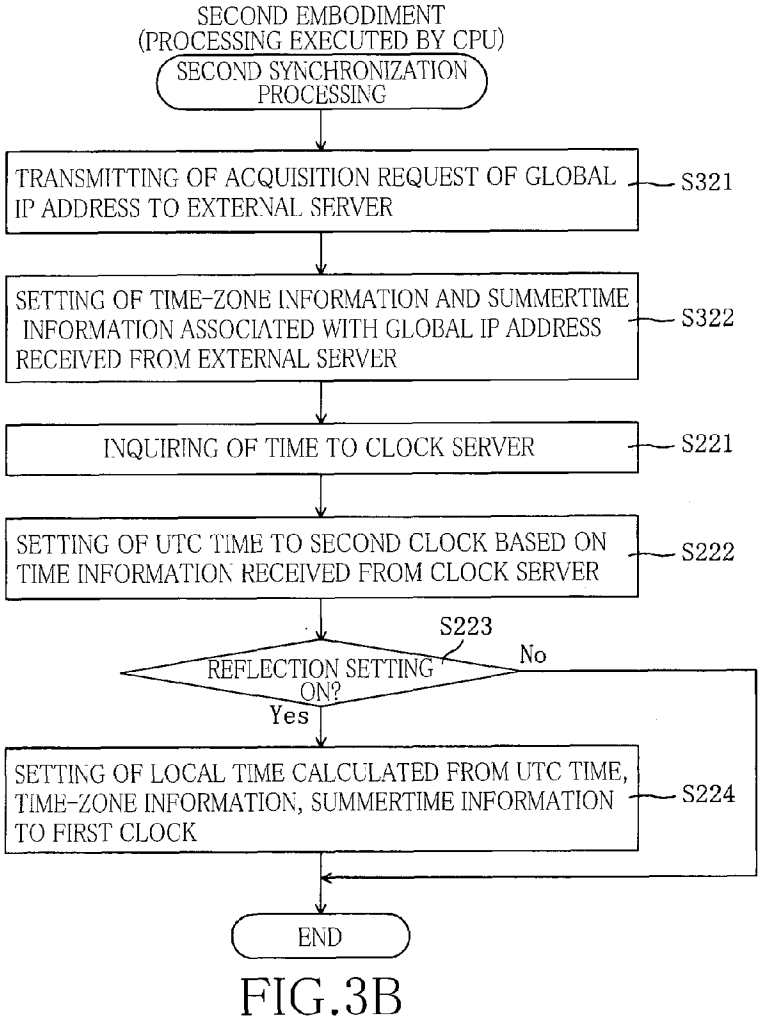
FIG. 3B is a flow chart showing a second synchronization processing in a third embodiment of the present invention.

FIG. 3B is a flow chart showing a second synchronization processing in the third embodiment. The second synchronization processing is a processing that the CPU 11 executes according to the control program 12*a* installed in the MFP 10 in the third embodiment. The second synchronization processing starts at predetermined time intervals, for example, every 24 hours, in a state in which the MFP 10 and the clock server 200 are connected to each other so as to be communicable with each other.

The CPU 11 transmits an acquisition request of the global IP address to the external server 300 through the wireless communication device 23 (S321). The external server 300 that received the acquisition request transmits the global IP address of the MFP 10 to the MFP 10 which requests the global IP address.

The flash memory 12 of the MFP 10 in the third embodiment stores an information table in which areas specified by global IP addresses are associated with time-zone information and summertime information, respectively. The CPU 11, by reference to the information table stored in the flash memory 12, sets the time-zone information and the summertime information specified by the global IP address received from the external server through the wireless communication device 23 as the time-zone information 12*b* and the summertime information 12*c*, respectively, and stores them (S322). After S322, the CPU 11 executes S221 through S224 and ends the processing, similarly in the first embodiment.

In the MFP 10 in the third embodiment, similar to the MFP 10 in the second embodiment, even if the MFP 10 is installed at a place different from the place previously installed, the local time is calculated based on the UTC time measured by the second clock 27 with high accuracy and the local time can be automatically set to the first clock 26 in accordance with the installation places of the MFP 10.

Hereinafter, a fourth embodiment will be described with reference to FIGS. 4A and 4B. In the first embodiment, when the synchronization notice is received from the PC 100, the synchronization of the first clock 26 based on the time information included in the synchronization notice is performed only in a case where the local time set to the first clock 26 is the initial value. In the fourth embodiment, the synchronization of the first clock 26 based on the time information received from the PC 100 is performed only in a case where the user permits the synchronization. In the fourth embodiment, the identical elements will be denoted by the reference numerals used in the first embodiment, and description thereof is omitted.

Figure 4A:
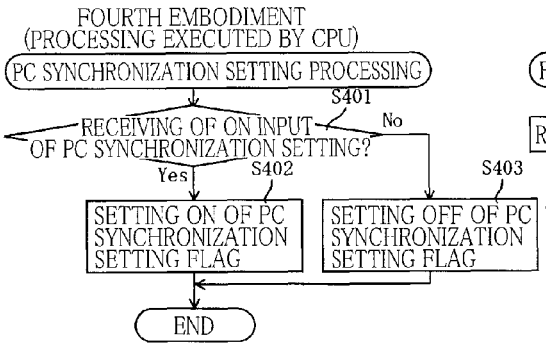
FIGS. 4A through 4E are flow charts showing aPC synchronization processing, a first synchronization processing in a forth embodiment of the present invention, a permitted PC setting processing in the forth embodiment, a first synchronization setting processing in a fifth embodiment of the present invention, and a first synchronization setting processing in a sixth embodiment of the present invention, respectively.

FIG. 4A is a flow chart showing a PC synchronization setting processing. FIG. 4B is a flow chart showing a first synchronization processing in the fourth embodiment. Each of the PC synchronization setting processing and the first synchronization processing is a processing executed by the CPU 11 according to the control program 12*a* that the MFP 10 in the fourth embodiment carries.

The PC synchronization setting processing in FIG. 4A is a processing in which a PC synchronization setting, i.e., a setting whether the synchronization of the first clock 26 based on the time information received from the PC 100 should be performed, is performed based on the user's input. The PC synchronization setting processing starts when an ON input or an OFF input of the PC synchronization setting based on the user's input is received. "The ON input of the PC synchronization setting" indicates that the synchronization of the first clock 26 based on the time information received from the PC 100 is performed. On the other hand, "the OFF input of the PC synchronization setting" indicates that the synchronization is not performed.

When the CPU 11 judges that the ON input of the PC synchronization setting is received (S401: YES), the CPU 11 sets a value of a PC synchronization setting flag (not shown) stored in the flash memory 12 at ON (S402), and ends the processing. The PC synchronization setting flag is a flag indicating whether the synchronization of the first clock 26 based on the time information received from the PC 100 is performed. In a case where the PC synchronization setting flag is ON, it indicates that the synchronization is performed, while, in a case where the PC synchronization setting flag is OFF, it indicates that the synchronization is not performed. In S401, when the CPU 11 judges that the ON input of the PC synchronization setting is not received (S401: NO), the CPU 11 sets the value of the PC synchronization setting flag at OFF (S403), and ends the processing.

Figure 4B:
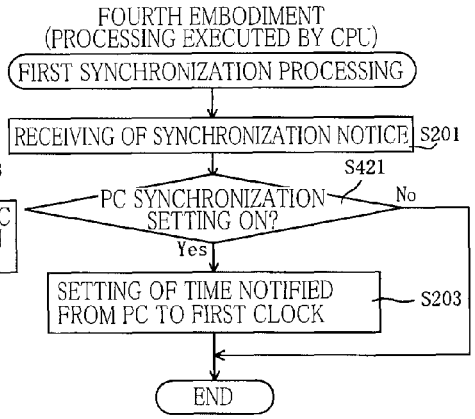

The first synchronization processing in FIG. 4B starts when the synchronization notice is received from the PC 100 in USB connection through the USB I/F 24, similarly in the first embodiment. The CPU 11 receives the synchronization notice transmitted from the PC 100 through the USB I/F 24 (S201). Then, the CPU 11 judges whether the PC synchronization setting is ON (S421). The judgment is performed based on the value of the PC synchronization setting flag. Specifically, in a case where the PC synchronization flag is set ON, the CPU 11 judges that the PC synchronization setting is ON. On the other hand, in a case where the PC synchronization setting flag is set OFF, the CPU 11 judges that the PC synchronization setting is OFF.

In S421, when the CPU 11 judges that the PC synchronization setting is ON (S421: YES), the CPU 11 sets a time indicated by the time information included in the synchronization notice received from the PC 100 to the first clock 26 as the local time of the MFP 10 (S203), and ends the processing. On the other hand, when the CPU 11 judges that the PC synchronization setting is OFF (S421: NO), the CPU 11 ends the processing.

In the MFP 10 of the fourth embodiment, the synchronization of the first clock 26 based on the time information received from the PC 100 is performed on condition that the PC synchronization setting is ON. ON or OFF of the PC synchronization setting is set based on the user's input, so that the synchronization of the first clock 26 based on the time information received from the PC 100 can be performed in accordance with the desire of the user.

Figure 4C:
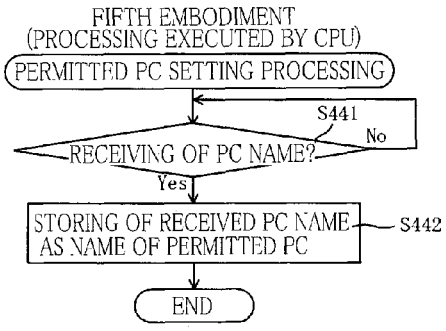
Figure 4D:
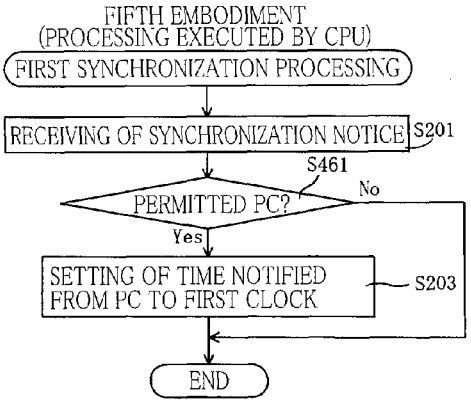

Hereinafter, a fifth embodiment will be described with reference to FIGS. 4C and 4D. In the fifth embodiment, the synchronization of the first clock 26 based on the time information received from the PC 100 is permitted only to the PC 100 that has been previously permitted. In the fifth embodiment, the identical elements will be denoted by the reference numerals used in the first embodiment, and description thereof is omitted. FIG. 4C is a flow chart showing a permitted PC setting processing, and FIG. 4D is a flow chart showing a first synchronization processing in the fifth embodiment. Each processing is a processing executed by the CPU 11 according to the control program 12*a* that the MFP 10 in the fifth embodiment carries.

The permitted PC setting processing shown in FIG. 4C is a processing in which setting of the PC 100, which is permitted to synchronize with the first clock 26, is performed based on the user's input. The processing starts when the input of the user instructing on the start of setting of the PC 100 that is permitted to synchronize with the first clock 26 is received. In a case where the CPU 11 does not receive the user's input of a PC name of the PC 100 permitted to synchronize with the first clock 26 (S441: NO), the CPU 11 waits to receive the user's input. When the CPU 11 receives the PC name of the PC 100 (S441: YES), the CPU 11 stores the received name of the PC 100 as a name of a permitted PC in the flash memory 12 (S442), and ends the processing.

The first synchronization processing in FIG. 4D starts when the synchronization notice is received from the PC 100 in USB connection through the USB I/F 24, similarly in the first embodiment. The CPU 11 receives the synchronization notice transmitted from the PC 100 through the USB I/F 24 (S201). In the present embodiment, the synchronization notice received from the PC 100 includes a PC name of the PC 100 that transmits the synchronization notice. The CPU 11 judges whether the PC name included in the synchronization notice is identical to the PC name stored in the flash memory 12 as the PC name of the permitted PC (S461). In S461, when the CPU 11 judges that the PC name included in the received synchronization notice is identical to the PC name stored in the flash memory 12 as the PC name of the permitted PC (S461: YES), the CPU 11 sets a time indicated by the time information included in the synchronization notice received from the PC 100 to the first clock 26 as the local time of the MFP 10 (S203), and ends the processing. On the other hand, the CPU 11 judges that the PC name included in the received synchronization notice is not identical to the PC name stored in the flash memory 12 as the PC name of the permitted PC (S461: NO), the CPU 11 ends the processing.

In the MFP 10 of the fifth embodiment, the synchronization of the first clock 26 based on the time information received from the PC 100 is performed on condition that the PC 100 transmitting the time information is identical to the PC 100 previously permitted based on the user's input. Therefore, the synchronization of the first clock 26 based on the time information received from the PC 100 can be performed in accordance with the desire of the user.

Hereinafter, a sixth embodiment will be described with reference to FIG. 4E. In the sixth embodiment, every time the synchronization notice is received from the PC 100, a screen, for asking the user whether the synchronization of the first clock 26 should be performed based on the time information included in the synchronization notice, is displayed on the LCD 16. The synchronization of the first clock 26 is permitted only in a case where the user's input indicates that the synchronization should be performed. In the sixth embodiment, the identical elements will be denoted by the reference numerals used in the first embodiment, and description thereof is omitted.

Figure 4E:
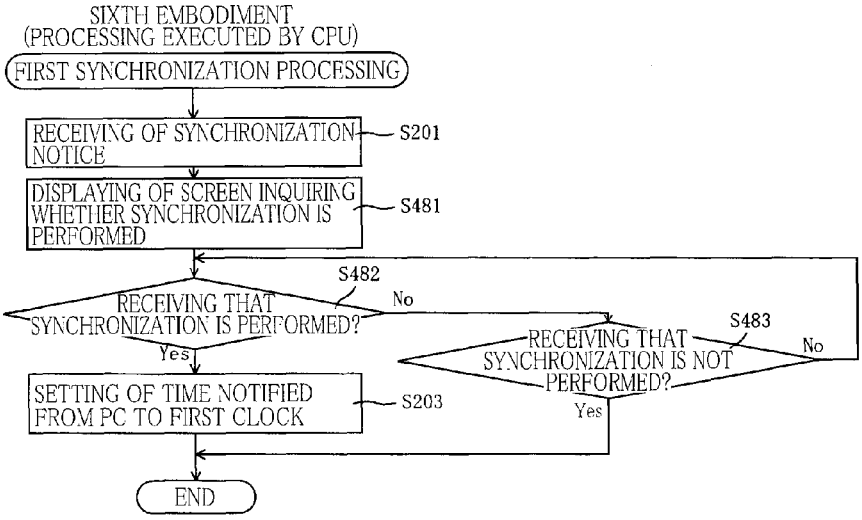

FIG. 4E is a flow chart showing a first synchronization processing in the sixth embodiment. The first synchronization processing is a processing executed by the CPU 11 according to the control program 12*a* that the MFP 10 in the sixth embodiment carries. The first synchronization processing starts in a case where the synchronization notice is received from the PC 100 in USB connection through the USB I/F 24, similarly in the first embodiment. The CPU 11 receives the synchronization notice transmitted from the PC 100 through the USB I/F 24 (S201).

Then, the CPU 11 controls the LCD 16 to display the screen for inquiring of the user whether the synchronization of the first clock 26 based on the time information included in the synchronization notice should be performed (S481). The CPU 11 judges that the user's input to the inquiry screen indicating that the synchronization should be performed is received or judges that the user's input indicating that the synchronization should not be performed is received (S482, S483). When neither is received (S482: NO, S483: NO), the CPU 11 waits until either of the user's input indicating that the synchronization should be performed or the user's input indicating that the synchronization should not be performed is received. When the CPU 11 judges that the user's input indicating that the synchronization should be performed is received (S482: YES), the CPU 11 sets a time indicated by the time information included in the synchronization notice received from the PC 100 to the first clock 26 as the local time of the MFP 10 (S203), and ends the processing. On the other hand, when the CPU 11 judges that the user's input indicating that the synchronization should not be performed is received (S482: NO, S483: YES), the CPU 11 ends the processing.

In the MFP 10 of the sixth embodiment, every time the time information is received from the PC 100, the user is inquired whether the synchronization of the first clock 26 is performed based on the received time information. The synchronization of the first clock 26 is performed based on the received time information, on condition that the user's input indicating that the synchronization should be performed is received. Therefore, the synchronization of the first clock 26 based on the time information received from the PC 100 can be performed in accordance with the user's desire.

In the illustrated embodiments, the MFP 10 is an example of an information processing apparatus. The PC 100 is an example of an external device. The wireless communication device 23 is an example of a communication device. The flash memory 12 is an example of a storage device. The CPU 11 is an example of a controller. Each of the time-zone information 12*b* and the summertime information 12*c* is an example of setting information. The PC name received in S441 is an example of specified information.

The present invention is not limited to the illustrated embodiments. It is to be understood that the present invention may be embodied with various changes and modifications that may occur to a person skilled in the art, without departing from the spirit and scope of the invention defined in the appended claims.

For example, though, in the illustrated embodiments, the MFP 10 capable of performing various functions is illustrated as an example of the information processing apparatus, other devices configured to be allowed to connect to an external device such as the PC 100 and the clock server 200, for example, a scanner having a single function, a PC, a portable device, a digital camera and so on may be adopted as the information processing apparatus.

In the illustrated embodiments, in order that the MFP 10 is in USB connection with the PC 100, the first synchronization processing starts when the synchronization notice is received from the PC 100 through the USB I/F 24. In addition to this, when the PC 100 transmits the synchronization notice at predetermined time intervals, for example, every 24 hours, the MFP 10 may be configured to start the first synchronization processing every time the synchronization notice is received. Further, when the MFP 10 and the PC 100 are connected to each other through network such as the Internet 500, the MFP 10 may be configured to start the first synchronization processing every time the synchronization notice is received.

Though in the illustrated embodiments, when the synchronization notice unilaterally transmitted from the PC 100 without a request from the MFP 10 is received, the MFP 10 may be configured to request the synchronization notice to the PC 100 at a predetermined timing and receive the synchronization notice transmitted from the PC 100 in response to the request.

In the fifth embodiment, only to the PC 100 specified by the PC name previously stored in the flash memory 12 as the permitted PC, the synchronization of the first clock 26 based on the time information received from the PC 100 is performed, but the specification of the PC 100 permitted to synchronize with the first clock 26 based on the time information is not limited to by the PC name. For example, the PC 100 permitted to synchronize with the first clock 26 based on the time information may be specified depending on connection paths of the PC 100. For example, the PC 100 in USB connection with the MFP 10 through the USB I/F 24 may be specified as the PC 100 permitted to synchronize with the first clock 26 based on the time information and may be distinguished from the PC 100 connected to the MFP 10 through the other connection paths, e.g., the Net I/F 25.

In the illustrated embodiments, the synchronization of the first clock 26 based on the time information provided from the clock server 200 is performed on condition that the reflection setting 12*d* set based on the user's input is ON, but the condition on which the synchronization of the first clock 26 based on the time information provided from the clock server 200 is performed is not limited to the reflection setting 12*d*. For example, the condition may be a case where a setting of a synchronization function of the second clock 27 is ON. The synchronization function of the second clock 27 is a function in which the second clock 27 is synchronized based on the time information received from the clock server 200, and in a case where the setting of the synchronization function is ON, the synchronization of the second clock 27 based on the time information received from the clock server 200 is performed. A setting value of the synchronization function of the second clock 27 is stored in the flash memory 12, and switching of ON and OFF of the setting of the synchronization function is performed based on the input of the user.

Figure 5A:
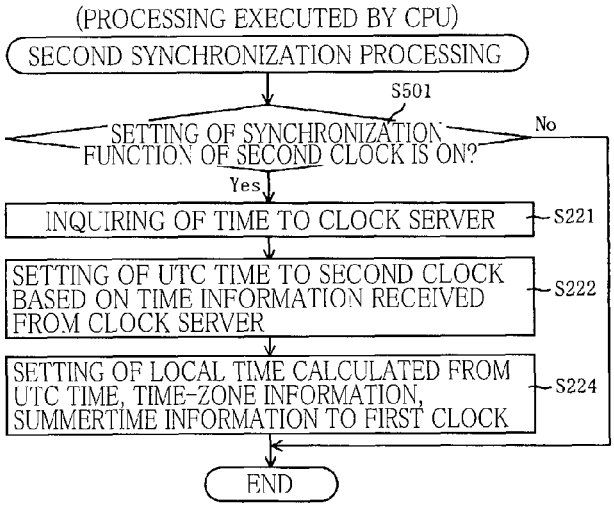
FIGS. 5A through 5C are flow charts each showing a second synchronization processing in each of modified examples.

FIG. 5A is a flow chart showing a second synchronization processing in the above-mentioned modified example. In the present modified example, the identical elements will be denoted by the reference numerals used in the first embodiment, and description thereof is omitted. The second synchronization processing in the present modified example is a processing executed by the CPU 11 according to the control program 12*a* that the MFP 10 in the present modified example carries.

The CPU 11 judges whether the setting of the synchronization function of the second clock 27 is ON (S501). When the CPU 11 judges that the setting of the synchronization function is ON (S501: YES), the CPU 11 executes S221, S222 and S224, similarly in the first embodiment, and ends the processing. On the other hand, when the CPU 11 judges that the setting of the synchronization function is OFF (S501: NO), the CPU 11 ends the processing.

As described above, ON and OFF of the setting of the synchronization function of the second clock 27 is switched by the input of the user, so that each synchronization of the second clock 27 and the first clock 26 based on the time information provided from the clock server 200 can be performed in accordance with the user's intention.

Further, a condition for performing the synchronization of the first clock 26 based on the time information provided from the clock server 200 may be a case where the UTC time set to the second clock 27 is an initial value. The condition may be a case where the UTC time measured by the second clock 27 is not an accurate value.

Figure 5B:
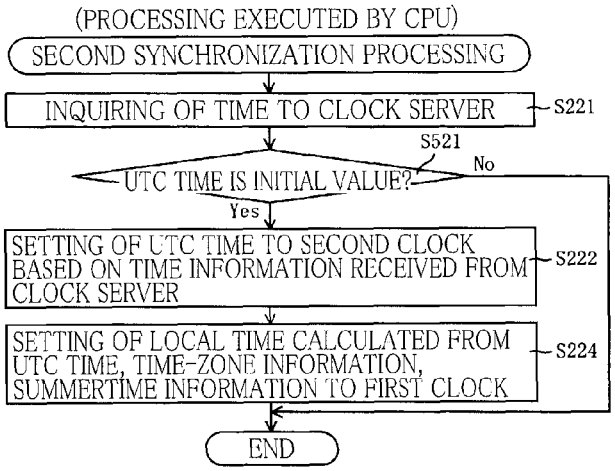
Figure 5C:
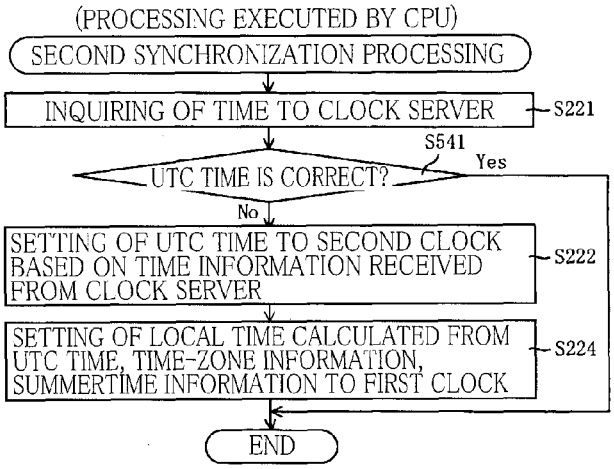

FIGS. 5B and 5C are flow charts each showing a second synchronization processing in each of the above-mentioned modified examples. In the respective modified examples, the identical elements will be denoted by the reference numerals used in the first embodiment, and description thereof is omitted. The second synchronization processing in each of the modified examples is a processing executed by the CPU 11 according to the control program 12*a* that the MFP 10 in each of the modified examples carries. Each second synchronization processing starts at predetermined time intervals, similarly in the second embodiment.

As shown in FIG. 5B, after executing S221 similarly in the first embodiment, the CPU 11 judges whether the UTC time set to the second clock 27 is an initial value (S521). This judgment is performed based on a value of an initial-value flag for the UTC time (not shown). Specifically, when the initial-value flag is set OFF, the CPU 11 judges that the UTC time set to the second clock 27 is the initial value. On the other hand, when the initial-value flag is set ON, the CPU 11 judges that the UTC time set to the second clock 27 is not the initial value. The initial-value flag for the UTC time is a flag stored in the second RAM 14 and set OFF at the shipment of the MFP 10, and when the flag is changed from a state at the timing of the shipment, the initial-value flag is ON. When the battery runs down in a state in which the main power source of the MFP 10 is off, the initial-value flag is initialized to be OFF.

In S521, when the CPU 11 judges that the UTC time set to the second clock 27 is the initial value (S521: YES), the CPU 11, similarly in the first embodiment, executes S222 and S224, and ends the processing. On the other hand, when the CPU 11 judges that the UTC time set to the second clock 27 is not the initial value (S521: NO), the CPU 11 ends the processing.

As shown in FIG. 5C, after executing S221 similarly in the first embodiment, the CPU 11 judges whether the UTC time measured by the second clock 27 is correct (S541). The judgment is performed by a comparison between the UTC time based on the time information received from the clock server 200 and the UTC time measured by the second clock 27. In S541, when the CPU 11 judges that the UTC time measured by the second clock 27 is incorrect (S541: NO), the CPU 11, similarly in the first embodiment, executes S222 and S224, and ends the processing. On the other hand, when the CPU 11 judges that the UTC time measured by the second clock 27 is correct (S541: YES), the CPU 11 ends the processing.

In the second and the third embodiments, when the MFP 10 receives the time-zone information and the summertime information associated with the global IP address of the MFP 10 from the external server 300, or when the MFP 10 acquires the summertime information based on the global IP address of the MFP 10 received from the external server 300, the MFP 10 saves (stores) the time-zone information and the summertime information as the time-zone information 12*b* and the summertime information 12*c*, respectively. Instead of this construction, the MFP 10 may be configured to, in a case of receiving or acquiring the time-zone information and the summertime information as described above, compare the time-zone information and the summertime information with the time-zone information 12*b* and the summertime information 12*c* that have been set, respectively. In a case where the time-zone information and the summertime information are identical with the time-zone information 12*b* and the summertime information 12*c*, respectively, the MFP 10 may perform no saving (overwriting), and in a case where the time-zone information and the summertime information are different from the time-zone information 12*b* and the summertime information 12*c*, the MFP 10 may write over the time-zone information 12*b* and the summertime information 12*c* on the time-zone information and the summertime information that have been received or acquired, respectively.

Further, in a case where the MFP 10 is configured to permit to overwrite the time-zone information 12*b* and the summertime information 12*c*, the MFP 10 may be configured to overwrite the time-zone information 12*b* and the summertime information 12*c* on the time-zone information and the summertime information that have been received or acquired, respectively. The permission to overwrite the time-zone information 12*b* and the summertime information 12*c* is performed based on the user's input.

Furthermore, every time the MFP 10 receives the time-zone information and the summertime information from the external server 300, or every time the MFP 10 acquires the time-zone information and the summertime information based on the global IP address received from the external server 300, the MFP 10 may be configured to display on the LCD 16 a screen inquiring whether the time-zone information and the summertime information that have been received or acquired are reflected to the time-zone information 12*b* and the summertime information 12*c*, respectively. Only when the input indicating that the reflection should be performed is received, the MFP 10 may be configured to overwrite the time-zone information 12*b* and the summertime information 12*c* on the time-zone information and the summertime information that have been received or acquired, respectively.

In the second and the third embodiments, each of S301, S302, S321, S322 is performed at predetermined time intervals. In addition to this construction, or instead of this construction, each of S301, S302, S321, S322 may be performed at other timings, for example, when the main power source of the MFP 10 is switched on.

In the illustrated embodiments, the time-zone information 12*b* and the summertime information 12*c* are stored in the flash memory 12, and the local time is calculated by the UTC time measured by the second clock 27, the time-zone information 12*b* and the summertime information 12*c*. Instead of this, either one of the time-zone information 12*b* and the summertime information 12*c* is stored in the flash memory 12. For example, in a case where the time-zone information 12*b* is stored in the flash memory 12, the local time that never considers the summertime information all year round is measured by the first clock 26. This modified example is useful in areas where the summertime is not adopted. Further, the time information in which the summertime information is considered may be received from the clock server 200, and the local time calculated from the time-zone information 12*b* and the UTC time that considers the summertime information based on the time information may be set to the first clock 26. On the other hand, it may be configured such that, in a case where the summertime information 12*c* is stored in the flash memory 12, the time information that considers the time-zone information is received from the clock server 200, and the local time calculated from the summertime information 12*c* and the UTC time that considers the time-zone information based on the time information is set to the first clock 26.

In the illustrated embodiments, the local time based on the time information received from the PC 100 or the clock server 200 is set to the first clock 26. In addition to this construction, it may be constructed such that a screen for the input of the local time by the user is displayed on the LCD 16, and the local time inputted by the user to the screen is set to the first clock 26.

Though in the illustrated embodiments and the modified examples, it is described that the CPU 11 is configured to execute each processing shown in FIGS. 2A through 5C, each processing shown in FIGS. 2A through 5C may be executed in cooperation with a plurality of CPUs. Further, an IC such as an ASIC may execute each processing shown in FIGS. 2A through 5C. Furthermore, the CPU 11 and the IC such as the ASIC may cooperate with each other to execute each processing shown in FIGS. 2A through 5C.

The information processing apparatus in the present invention may be constructed as a combination that properly combines the constructions illustrated in the first through sixth embodiments with the contents of each of the modified examples. For example, it may be constructed such that the condition for executing S203 in the first synchronization processing is a combination properly combining a plurality of conditions among the conditions used in the first synchronization processing in the first, the fourth, the fifth and the sixth embodiments, respectively. In a case where one of the plurality of the conditions is met, S203, i.e., the synchronization of the first clock 26 based on the time information received from the clock server 200 is executed.

The present invention can be adopted in various configurations such as a controller controlling an information processing apparatus, an information processing system, an information processing method, an information processing program, and a recording medium on which an information processing program is recorded.

What is claimed is:

1. An information processing apparatus comprising:

a communication device capable of communicating with an external device and capable of communicating with a clock server via a network, the external device being configured to provide first time information, the clock server being configured to provide second time information relating to a UTC time;

a first clock configured to measure a first time as a local time;

a second clock configured to measure a second time relating to the UTC time, a storage device configured to store updating information for updating the local time of the first clock based on the second time of the second clock; and a controller configured to perform:

updating the second time of the second clock based on the second time information when the second time information is provided from the clock server;

updating the local time of the first clock based on the second time information and the updating information when the second time of the second clock is updated;

judging whether the local time of the first clock has been updated based on one of the first time information and the second time information, when the time information is provided from the external device;

updating the local time based on the first time information provided from the external device when it is judged that the local time has not been updated based on any one of the first time information and the second time information;

not updating the local time based on the first time information when it is judged that the local time has been updated based on the second time information.

2. The information processing apparatus according to claim 1, wherein, when the local time of the first clock is an initial value, the controller is configured to judge that the local time has not been updated based on the second time information.

3. The information processing apparatus according to claim 1, wherein the controller is configured to update the local time based on the first time information provided from the external device, when the controller receives a permission instruction which permits to update the local time based on the first time information provided from the external device.

4. The information processing apparatus according to claim 1, wherein, when the time information is provided from the external device, the controller is configured to:

control a display device to display an inquiry image inquiring whether the local time is to be updated based on the first time information provided from the external device, and update the local time based on the first time information provided from the external device, when the controller receives an input indicating that the local time is to be updated based on the first time information provided from the external device, in response to displaying of the inquiry image on the display device.

5. The information processing apparatus according to claim 1, wherein the storage device is further configured to store specified information for specifying an external device which provides the first time information for updating the local time of the first clock, in response to receiving of the specified information, wherein the controller is configured to, when an external device which is currently connected to the communication device is identical to the external device which is specified by the specified information stored in the storage device, update the local time based on the first time information provided from the currently connected external device.

6. The information processing apparatus according to claim 1, wherein the controller is configured to receive the first time information from the external device, in response to connection of the communication device to the external device.

7. The information processing apparatus according to claim 1, wherein the storage device is further configured to store, as the updating information, at least one of time-zone information which indicates a time difference relative to the second time of the second clock and summertime information which indicates whether the summertime is set, wherein the controller is configured to, on condition that the at least one of the time-zone information and the summertime information is stored in the storage device, update the local time of the first clock by correcting the second time of the second clock based on the at least one of the time-zone information and the summertime information, to the first clock as the local time.

8. The information processing apparatus according to claim 1, wherein the communication device is capable of communicating with an external server via the network, wherein, when the controller receives a global IP address of the information processing apparatus from the external server, or when the controller receives from the external server information specified in the external server based on the global IP address and at least one of time-zone information which indicates a time difference relative to the second time of the second clock and summertime information which indicates whether the summertime is set, the controller is configured to update the local time of the first clock by correcting the second time of the second clock, based on the at least one of the time-zone information and the summertime information specified based on the global IP address received by the controller, or based on the at least one of the time-zone information and the summertime information received by the controller.

* * * * *